US009828942B2

(12) United States Patent
Kamen et al.

(10) Patent No.: US 9,828,942 B2
(45) **Date of Patent: *Nov. 28, 2017**

(54) THERMAL ENERGY RECOVERY SYSTEM

(71) Applicant: New Power Concepts LLC, Manchester, NH (US)

(72) Inventors: Dean Kamen, Bedford, NH (US); Christopher C. Langenfeld, Nashua, NH (US)

(73) Assignee: New Power Concepts LLC, Manchester, NH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/262,770

(22) Filed: Sep. 12, 2016

(65) Prior Publication Data

US 2016/0377025 A1 Dec. 29, 2016

Related U.S. Application Data

(63) Continuation of application No. 12/429,773, filed on Apr. 24, 2009, now Pat. No. 9,441,575.

(60) Provisional application No. 61/047,796, filed on Apr. 25, 2008.

(51) Int. Cl.

| | |
|---|---|
| ***F02G 1/043*** | (2006.01) |
| ***F01K 23/06*** | (2006.01) |
| ***F02G 5/02*** | (2006.01) |
| ***F01K 25/08*** | (2006.01) |
| ***F01D 15/10*** | (2006.01) |
| ***F01K 23/10*** | (2006.01) |

(52) U.S. Cl.

CPC ..... *F02G 5/02* (2013.01); *F01D 15/10* (2013.01); *F01K 23/065* (2013.01); *F01K 23/103* (2013.01); *F01K 25/08* (2013.01); *F02G 1/043* (2013.01); *F02G 2243/30* (2013.01); *F02G 2256/04* (2013.01); *F02G 2280/20* (2013.01)

(58) Field of Classification Search

CPC ..... F02G 1/043; F02G 5/02; F02G 2243/30; F02G 2256/04; F02G 2280/20; F01K 23/065; F01K 23/103; F01K 25/08; F01D 15/10

See application file for complete search history.

(56) References Cited

U.S. PATENT DOCUMENTS 6,883,328 B2 * 4/2005 Bronicki ..... F01K 13/00 60/646
2004/0231331 A1 * 11/2004 Iwanami ..... F01C 13/00 60/670

(Continued)

*Primary Examiner* — Audrey K Bradley
(74) *Attorney, Agent, or Firm* — Michael George Norris

(57) ABSTRACT

A thermal energy recovery system. The system includes a Stirling engine having a burner thermal energy output. Also, a superheater mechanism for heating the thermal energy output and an expansion engine coupled to a generator. The expansion engine converts the thermal energy output from the burner to mechanical energy output. The generator converts mechanical energy output from the expansion engine to electrical energy output. The expansion engine may also includes vapor output. Some embodiments of the system further include a condenser for condensing the vapor output, a pump for pumping the vapor output and a boiler in fluid communication with the pump. The pump pumps the vapor output to the boiler.

12 Claims, 7 Drawing Sheets

(56) References Cited

U.S. PATENT DOCUMENTS

2005/0167173 A1* 8/2005 Hoetger ..... F01K 15/02
180/69.6
2006/0277910 A1* 12/2006 Hoetger ..... C09K 5/10
60/651

* cited by examiner

READY FOR START OF COMPRESSION STROKE

END OF COMPRESSION STROKE

READY FOR START OF EXPANSION STROKE

END OF EXPANSION STROKE

THERMAL ENERGY RECOVERY SYSTEM

CROSS REFERENCE TO RELATED APPLICATIONS

The present application is Continuation of U.S. patent application Ser. No. 12/429,773, filed Apr. 24, 2009, entitled Thermal Recovery System, now U.S. Pat. No. 9,441,575 issued Sep. 13, 2016 , which is a Non-provisional of U.S. Provisional Patent Application 61/047,796, filed Apr. 25, 2008, entitled Thermal Recovery System, which are each herein incorporated by reference in their entirety.

TECHNICAL FIELD

The present invention relates to machines and more particularly, to a thermal energy recovery system.

BACKGROUND INFORMATION

Engines and machines may be characterized by their efficiency. It is often desirable to increase the efficiency of an engine/machine to increase the output or work generated from a given input or fuel. Accordingly, there is a need for a thermal energy recovery system for engines and machines to increase their efficiency.

SUMMARY

In accordance with one aspect of the present invention, a thermal energy recovery system is described. The system includes a Stirling engine having a burner thermal energy output. Also, a superheater mechanism for heating the thermal energy output and an expansion engine coupled to a generator. The expansion engine converts the thermal energy output from the burner to mechanical energy output. The generator converts mechanical energy output from the expansion engine to electrical energy output. The expansion engine also includes vapor output. Also included in the system is a condenser for condensing the vapor output, a pump for pumping the vapor output and a boiler in fluid communication with the pump. The pump pumps the vapor output to the boiler.

Some embodiments of this aspect of the present invention may include one or more of the following features. The Stirling engine may include a rocking beam drive mechanism. The condenser may be a radiator.

In accordance with one aspect of the present invention, a thermal energy recovery system is described. The thermal energy recovery system includes a Stirling engine having a burner thermal energy output, a superheater mechanism for heating the thermal energy output, and an expansion engine coupled to a generator. The expansion engine converts the thermal energy output from the burner to mechanical energy output and the generator converts mechanical energy output from the expansion engine to electrical energy output.

Some embodiments of this aspect of the present invention may include one or more of the following features. The expansion engine may have a vapor output. The thermal energy recovery system may further include a condenser for condensing the vapor output. The thermal energy recovery system may further include a pump for pumping the vapor output. The thermal energy recovery system may further include a boiler in fluid communication with the pump, wherein the pump pumps the vapor output to the boiler.

In accordance with one aspect of the present invention, a method for thermal energy recovery is described. The method includes capturing thermal energy output from a burner in Stirling engine, heating the thermal energy output using a superheater mechanism, converting the thermal energy output to mechanical energy output using an expansion engine, and converting the mechanical energy output to electrical energy output using a generator.

Some embodiments of this aspect of the present invention may include one or more of the following features. Condensing vapor output from the expansion engine. Some embodiments may include pumping the condensed vapor to a boiler.

These aspects of the invention are not meant to be exclusive and other features, aspects, and advantages of the present invention will be readily apparent to those of ordinary skill in the art when read in conjunction with the appended claims and accompanying drawings.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

Figure 1A:
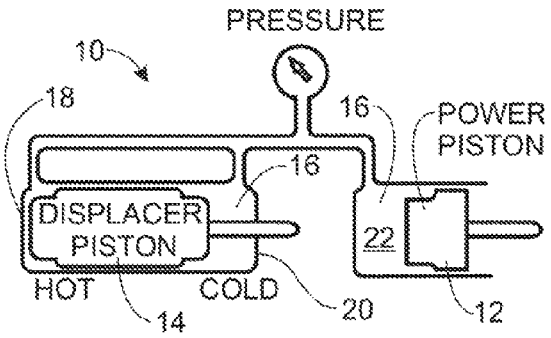
FIG. 1A PRIOR ART
FIGS. 1A-1E depict the principles of operation of a prior art Stirling cycle machine.

Stirling cycle machines, including engines and refrigerators, have a long technological heritage, described in detail in Walker, Stirling Engines, Oxford University Press (1980), incorporated herein by reference. The principle underlying the Stirling cycle engine is the mechanical realization of the Stirling thermodynamic cycle: isovolumetric heating of a gas within a cylinder, isothermal expansion of the gas (during which work is performed by driving a piston), isovolumetric cooling, and isothermal compression. Additional background regarding aspects of Stirling cycle machines and improvements thereto is discussed in Hargreaves, The Phillips Stirling Engine (Elsevier, Amsterdam, 1991), which is herein incorporated by reference.

The principle of operation of a Stirling cycle machine is readily described with reference to FIGS. 1A-1E, wherein identical numerals are used to identify the same or similar parts. Many mechanical layouts of Stirling cycle machines are known in the art, and the particular Stirling cycle machine designated generally by numeral 10 is shown merely for illustrative purposes. In FIGS. 1A to 1D, piston 12 and a displacer 14 move in phased reciprocating motion within the cylinders 16 which, in some embodiments of the Stirling cycle machine, may be a single cylinder, but in other embodiments, may include greater than a single cylinder. A working fluid contained within cylinders 16 is constrained by seals from escaping around piston 12 and displacer 14.

The working fluid is chosen for its thermodynamic properties, as discussed in the description below, and is typically helium at a pressure of several atmospheres, however, any gas, including any inert gas, may be used, including, but not limited to, hydrogen, argon, neon, nitrogen, air and any mixtures thereof. The position of the displacer 14 governs whether the working fluid is in contact with the hot interface 18 or the cold interface 20, corresponding, respectively, to the interfaces at which heat is supplied to and extracted from the working fluid. The supply and extraction of heat is discussed in further detail below. The volume of working fluid governed by the position of the piston 12 is referred to as the compression space 22.

Figure 1B:
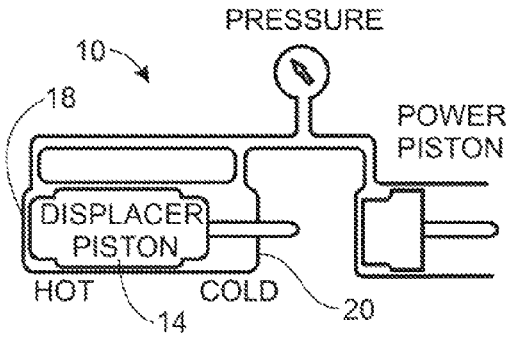
FIG. 1B PRIOR ART
Figure 1C:
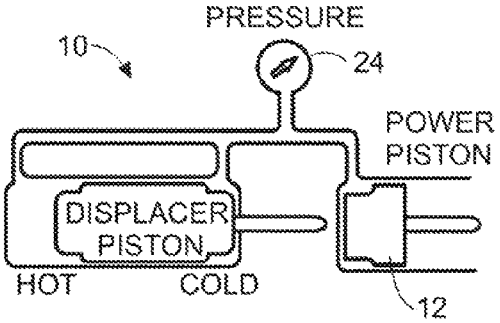
FIG. 1C PRIOR ART

During the first phase of the Stirling cycle, the starting condition of which is depicted in FIG. 1A, the piston 12 compresses the fluid in the compression space 22. The compression occurs at a substantially constant temperature because heat is extracted from the fluid to the ambient environment. The condition of the Stirling cycle machine 10 after compression is depicted in FIG. 1B. During the second phase of the cycle, the displacer 14 moves in the direction of the cold interface 20, with the working fluid displaced from the region of the cold interface 20 to the region of the hot interface 18. This phase may be referred to as the transfer phase. At the end of the transfer phase, the fluid is at a higher pressure since the working fluid has been heated at constant volume. The increased pressure is depicted symbolically in FIG. 1C by the reading of the pressure gauge 24.

Figure 1D:
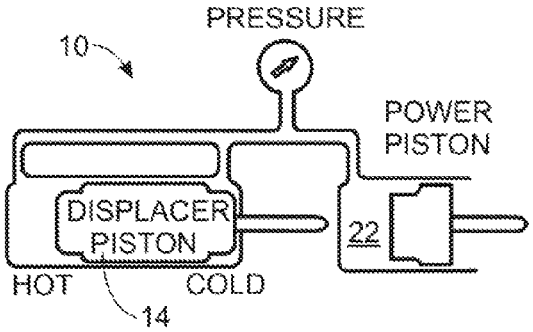
FIG. 1D PRIOR ART
Figure 1E:
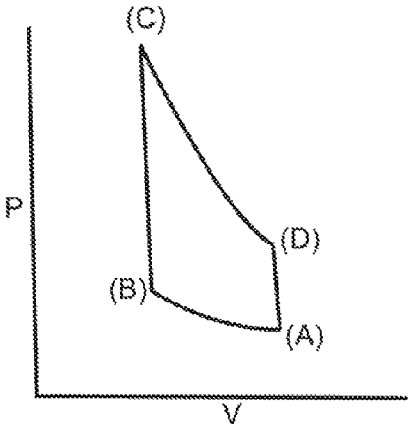
FIG. 1E PRIOR ART

During the third phase (the expansion stroke) of the Stirling cycle machine, the volume of the compression space 22 increases as heat is drawn in from outside the Stirling cycle machine 10, thereby converting heat to work. In practice, heat is provided to the fluid by means of a heater head (not shown) which is discussed in greater detail in the description below. At the end of the expansion phase, the compression space 22 is full of cold fluid, as depicted in FIG. 1D. During the fourth phase of the Stirling cycle machine 10, fluid is transferred from the region of the hot interface 18 to the region of the cold interface 20 by motion of the displacer 14 in the opposing sense. At the end of this second transfer phase, the fluid fills the compression space 22 and cold interface 20, as depicted in FIG. 1A, and is ready for a repetition of the compression phase. The Stirling cycle is depicted in a P-V (pressure-volume) diagram as shown in FIG. 1E.

Additionally, on passing from the region of the hot interface 18 to the region of the cold interface 20, in some embodiments, the fluid may pass through a regenerator. A regenerator is a matrix of material having a large ratio of surface area to volume which serves to absorb heat from the fluid when it enters from the region of the hot interface 18 and to heat the fluid when it passes from the region of the cold interface 20.

Stirling cycle machines have not generally been used in practical applications due to several daunting challenges to their development. These involve practical considerations such as efficiency and lifetime. Accordingly, there is a need for more Stirling cycle machines with higher thermodynamic efficiencies.

Thermal Energy Recovery System

Various machines generate waste heat. The thermal energy from the waste heat may be converted to another form of energy, for example, but not limited to, mechanical energy. A generator may be used to convert mechanical energy into electrical energy.

Figure 2:
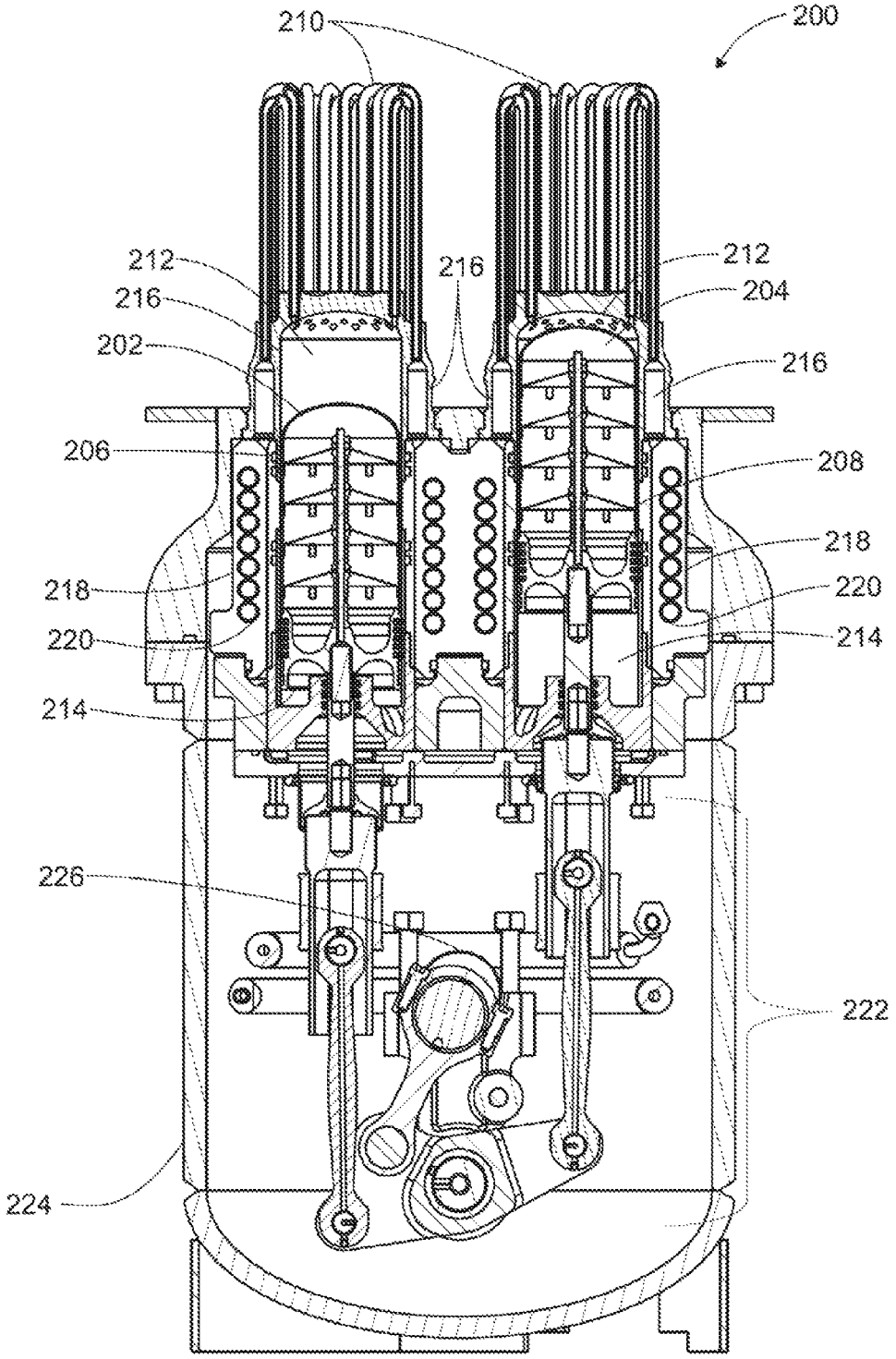
FIG. 2 shows a view of an engine in accordance with one embodiment.

Referring now to FIG. 2, one embodiment of the engine is shown. This embodiment is shown as an exemplary embodiment, other embodiments may include various engines, including but not limited to, various Stirling cycle machines. The Stirling engine, in the exemplary embodiment, may be a Stirling engine, including but not limited to, any described in U.S. Patent Publication No. 2008/0314356 to Kamen et al., and entitled Stirling Cycle Machine, which published on Dec. 25, 2008, and which is herein incorporated by reference in its entirety.

Figure 3A:
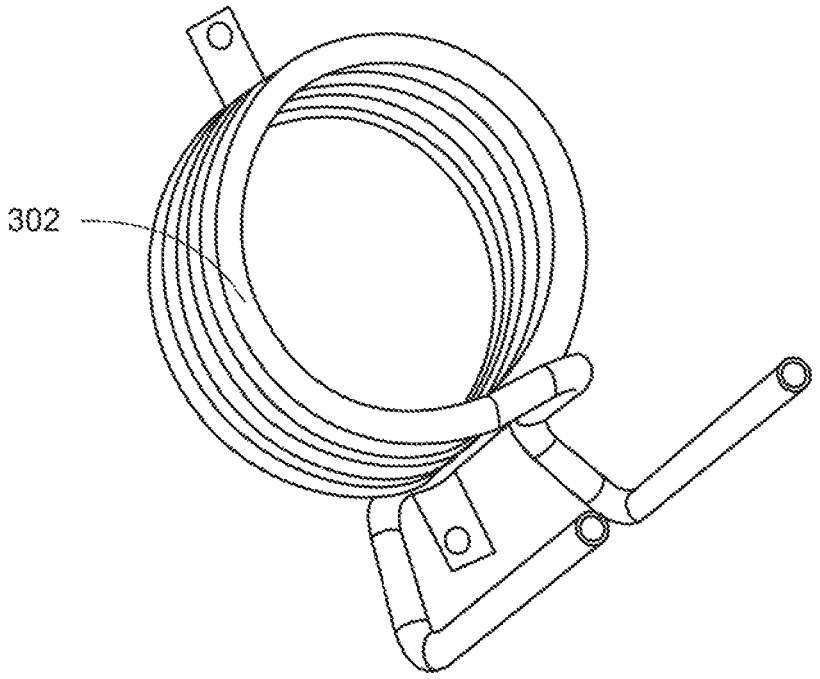
FIGS. 3A-3B show views of a cooler in accordance with one embodiment.
Figure 3B:
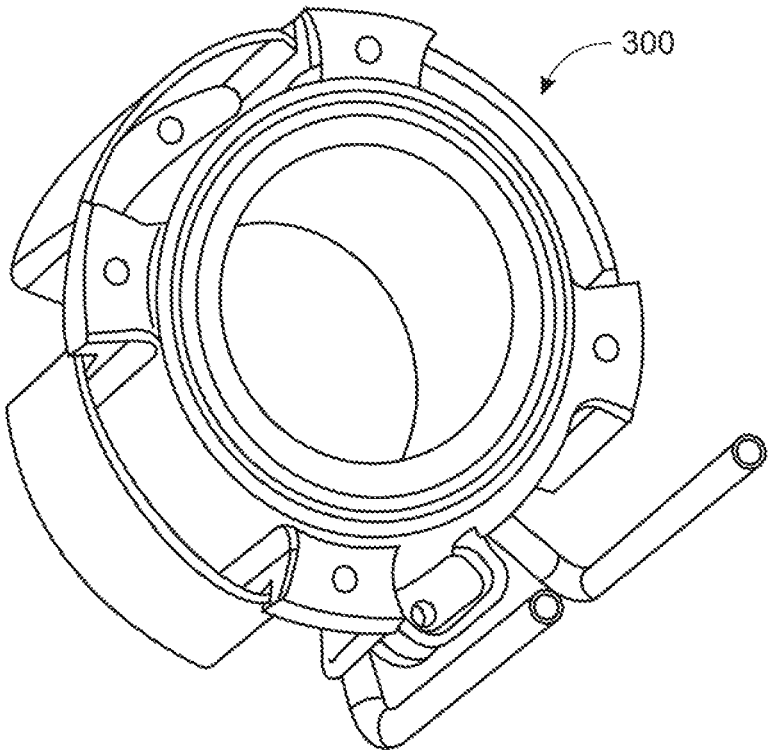

Still referring to FIG. 2, the pistons 202 and 204 of engine 200 operate between a hot chamber 212 and a cold chamber 214 of cylinders 206 and 208 respectively. Between the two chambers there may be a regenerator 216. The regenerator 216 may have variable density, variable area, and, in some embodiments, is made of wire. The varying density and area of the regenerator may be adjusted such that the working gas has substantially uniform flow across the regenerator 216. When the working gas passes through the hot chamber 212, a heater head 210 may heat the gas causing the gas to expand and push pistons 202 and 204 towards the cold chamber 214, where the gas compresses. As the gas compresses in the cold chamber 214, pistons 202 and 204 may be guided back to the hot chamber 212 to undergo the Stirling cycle again. In some embodiments, a cooler 218 (also shown in FIG. 3B as 300) may be positioned alongside cylinders 206 and 208 to further cool the gas passing through to the cold chamber 214. Cooler 218 is used to transfer thermal energy by conduction from the working gas and thereby cool the working gas. A coolant, for example, but not limited to, water, a refrigerant, or another fluid, is carried through the cooler 218 by coolant tubing 220 (also shown in FIG. 3A as 302). In the exemplary embodiment, engine 200 includes a drive mechanism, such as a rocking beam drive mechanism 222. However, in other embodiments, other drive mechanisms known in the art are used.

Engines, such as, for example, Stirling cycle engines, may convert chemical energy stored in a fuel into electrical energy by combusting the fuel to release thermal energy. Using a mechanical drive mechanism, such as, but not limited to, an expansion engine, which may include, but are not limited to, a turbine, reciprocating piston, or rotor, thermal energy is converted into mechanical energy. A generator may be used to convert the mechanical energy into electrical energy. For purposes of this description, the terms "thermal output", "mechanical output" and "electrical output" are synonymous with thermal energy output or thermal energy, mechanical energy output or mechanical energy, and electrical energy output or electrical energy, respectively.

Figure 4:
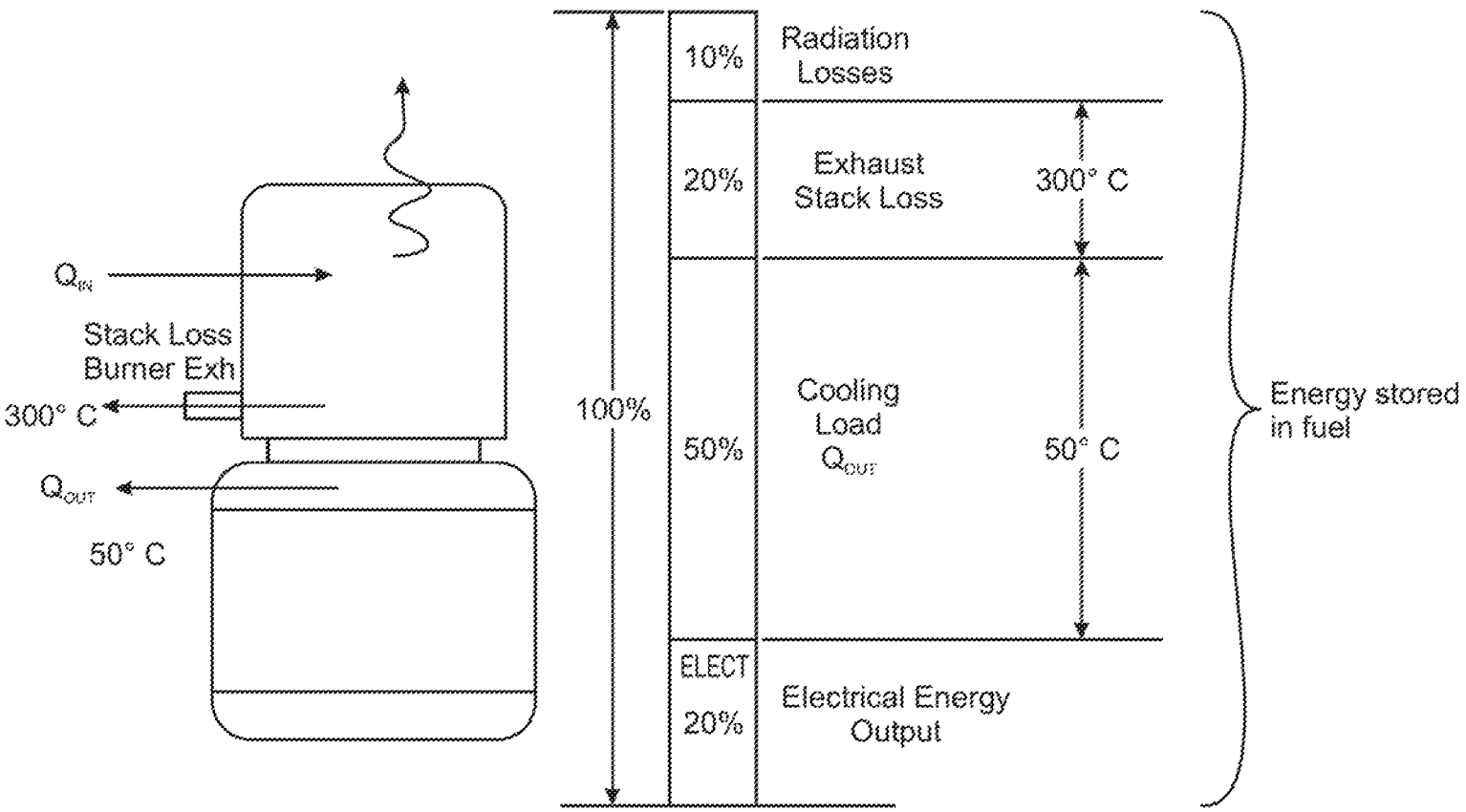
FIG. 4 shows an energy diagram in accordance with one embodiment.

The following description refers to percentages. However, these are approximate and may vary throughout various embodiments. In the exemplary embodiment, these percentages are given by way of illustration and example, these percentages are not intended to be limiting. Referring to FIG. 4, in some embodiments, about 20% of the chemical energy stored in the fuel may be converted into electrical energy, which results in an overall engine efficiency of about 20%. In some embodiments, of the remaining 80% of the chemical energy stored in the fuel, about 10% may be converted to thermal radiation losses, about 20% may be converted to heat losses from an exhaust stack, and about 50% may be converted into thermal losses to the coolant. In some embodiments, the fluid exiting the exhaust stack may be at a temperature of about 300 degrees C., and the coolant may exit the cooler at about 50 degrees C.

In some embodiments, to increase the overall efficiency of the engine, a thermal energy recovery system may be used.

Figure 5:
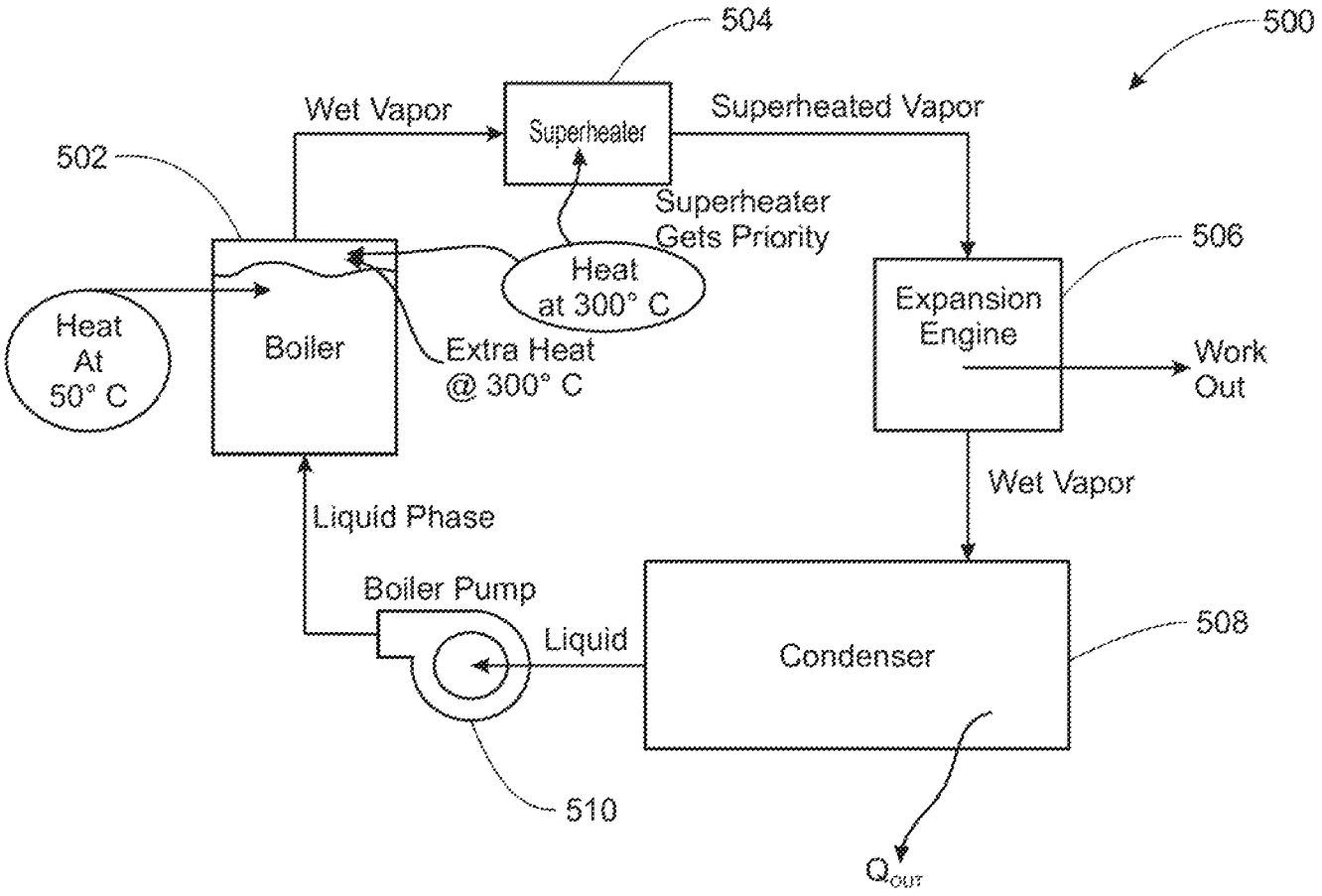
FIG. 5 shows a thermal energy recovery system in accordance with one embodiment.

Referring now to FIG. 5, in the exemplary embodiment, a machine, which in some embodiments is an expansion engine 506, is incorporated into a thermal energy recovery system, such as the one referred to generally by numeral 500. In the exemplary embodiment, the expansion engine 506 may also be a Stirling engine such as one shown in FIG. 2 as 200 and which is also described more fully in U.S. Patent Publication No. 2008/0314356 to Kamen et al., and entitled Stirling Cycle Machine, which published on Dec. 25, 2008, which is herein incorporated by reference in its entirety. However, in various other embodiments, the expansion engine 506 may be any expansion engine known in the art. The expansion engine 506 recovers energy losses that occur during the operation of the engine as discussed above. That is, an operating engine generates thermal energy output or thermal output. To capture this energy rather than allowing the energy to dissipate out of the system, an expansion engine 506 may be used. The expansion engine 506 may convert the thermal energy output from the engine to mechanical energy output. In some embodiments, the thermal energy recovery system 500 may employ a Rankine cycle to convert thermal energy into mechanical or electrical energy. In other embodiments, the expansion engine 506 used may be any engine capable of functioning to convert mechanical energy into electrical energy. However, in still other embodiments, the engine used may be capable of functioning to convert thermal energy to any other desired type of energy. The mechanical energy generated by the expansion engine 506 may itself be converted to another form of energy, for example, electrical energy. Additionally, the expansion engine 506 may itself generate wet vapor into the system.

Figure 6:
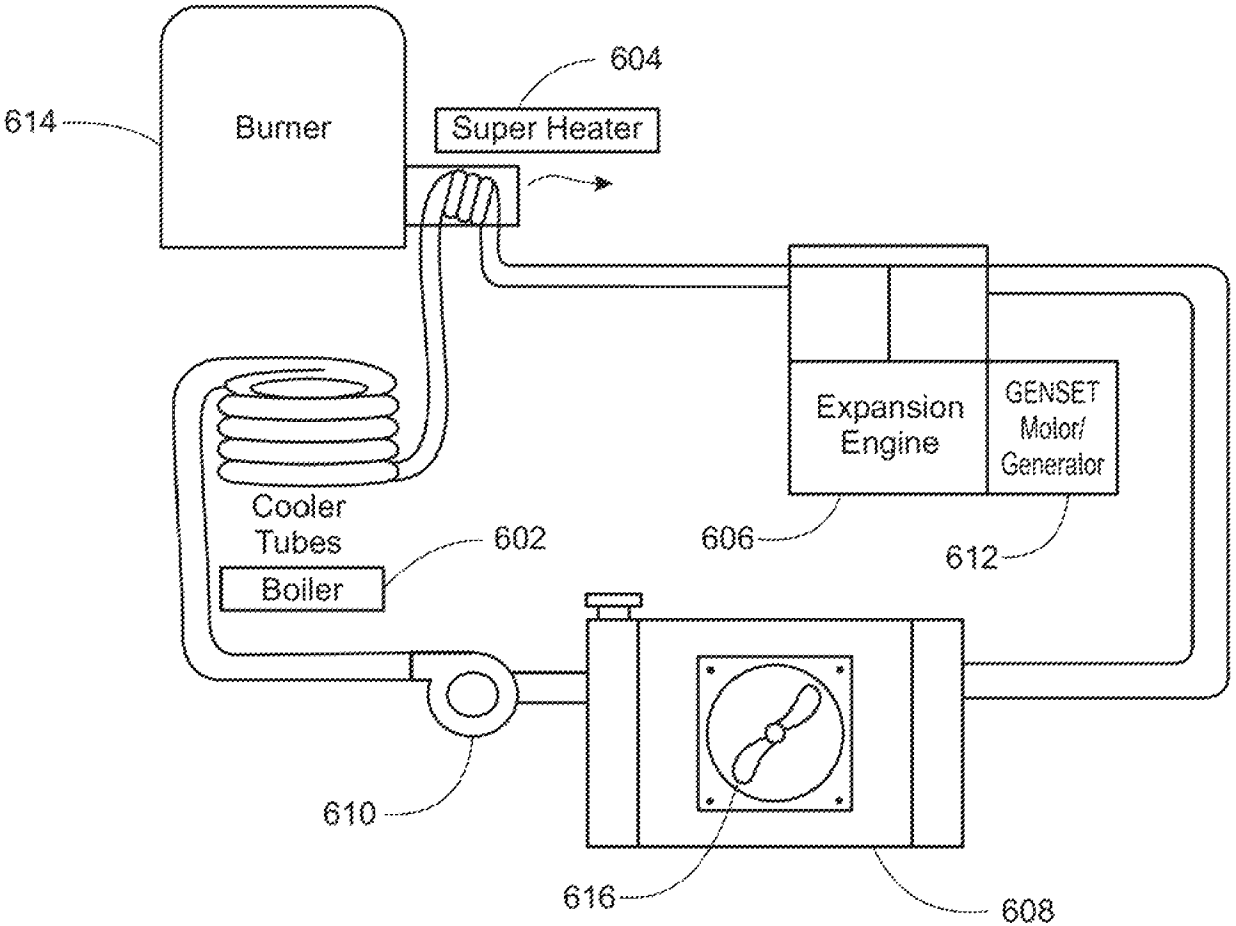
FIG. 6 shows a thermal energy recovery system in accordance with one embodiment.

Still referring to FIG. 5, in some embodiments, the thermal energy recovery system 500 includes, but is not limited to, a boiler 502 (also shown as 602 in FIG. 6), a superheater mechanism ("superheater") 504 (also shown as 604 in FIG. 6), an expansion engine 506 (also shown as 606 in FIG. 6), a condenser 508 (also shown as 608 in FIG. 6), a pump 510 (also shown as 610 in FIG. 6), and a working fluid that is circulated throughout the system 500. The system 500 may further include a motor/generator (shown as 612 in FIG. 6) coupled to the expansion engine 506. For purposes of this description, the term "motor/generator" means a device that may be either a motor or a generator, or a motor and a generator. In some embodiments, the working fluid may be a refrigerant, water in a vacuum, or other fluids which may vaporize at the boiler temperature. In some embodiments, the thermal energy recovery system 500 may be positioned inside the crankcase of an engine (such as crankcase 224 of engine 200, as shown in FIG. 2), or may be positioned outside of the crankcase of an engine.

The boiler 502 may heat the working fluid into a vapor, such as a wet vapor. In some embodiments, the boiler 502 may extract heat from the coolant of a primary engine to vaporize the working fluid of the thermal energy recovery system 500. In some embodiments, a fluid-to-fluid or liquid-to-liquid heat exchanger may be used to transfer heat from the coolant of the expansion engine 506 to the working fluid of the thermal energy recovery system 500. In some embodiments, the working fluid of the thermal energy recovery system 500 may be the coolant of the primary engine, which may eliminate the need for a fluid-to-fluid heat exchanger. In embodiments where the working fluid of the thermal energy recovery system 500 is the coolant of the expansion engine 506, the boiler 502 of thermal energy recovery system 500 may be the cooler of a expansion engine 506 (such as cooler 218 of engine 200 in FIG. 2.), as shown by numeral 602 in FIG. 6.

The vapor, or wet vapor, exiting the boiler 502 may then be transferred to the superheater 504, where it may be superheated into a dry, superheated vapor. In some embodiments of the system, the superheater 504 may be used to transfer heat from the hot exhaust gases of a expansion engine 506, such as engine 200 in FIG. 2, to the working fluid of the thermal energy recovery system 500. In some embodiments, the superheater 504 may be coupled to, integrated in, or mounted on the burner (shown as 614 in FIG. 6) of a expansion engine 506. Any residual heat contained in the superheater 504 may be transferred to the boiler 502.

The superheated vapor exiting the superheater 504 may then be transferred to the expansion engine 506, which converts the thermal energy stored in the superheated vapor into mechanical energy. The expansion engine 506 may be, but is not limited to, a turbine engine, a rotor engine, such as a wankel rotor engine, a reciprocating piston engine, or any other engine. The expansion engine 506 may be coupled to the primary crankshaft of the expansion engine 506 (such as crankshaft 226 of engine 200 shown in FIG. 2), or may be coupled to an independent crankshaft.

A motor/generator (shown as 612 in FIG. 6), such as a Permanent Magnetic ("PM") generator, may be coupled to the expansion engine 506 to convert the mechanical energy produced by the expansion engine 506 into electrical energy. In embodiments where the expansion engine 506 is mounted on the primary crankshaft of an engine, a single motor/generator may be used to convert the mechanical energy of both the expansion engine and the primary engine. However, in other embodiments, the motor/generator may be a mechanical load found in another system combined with the current system. As a non-limiting example, in some embodiments, the motor/generator may be an Air Conditioner ("AC") compressor, which drives a motor.

Figure 7:
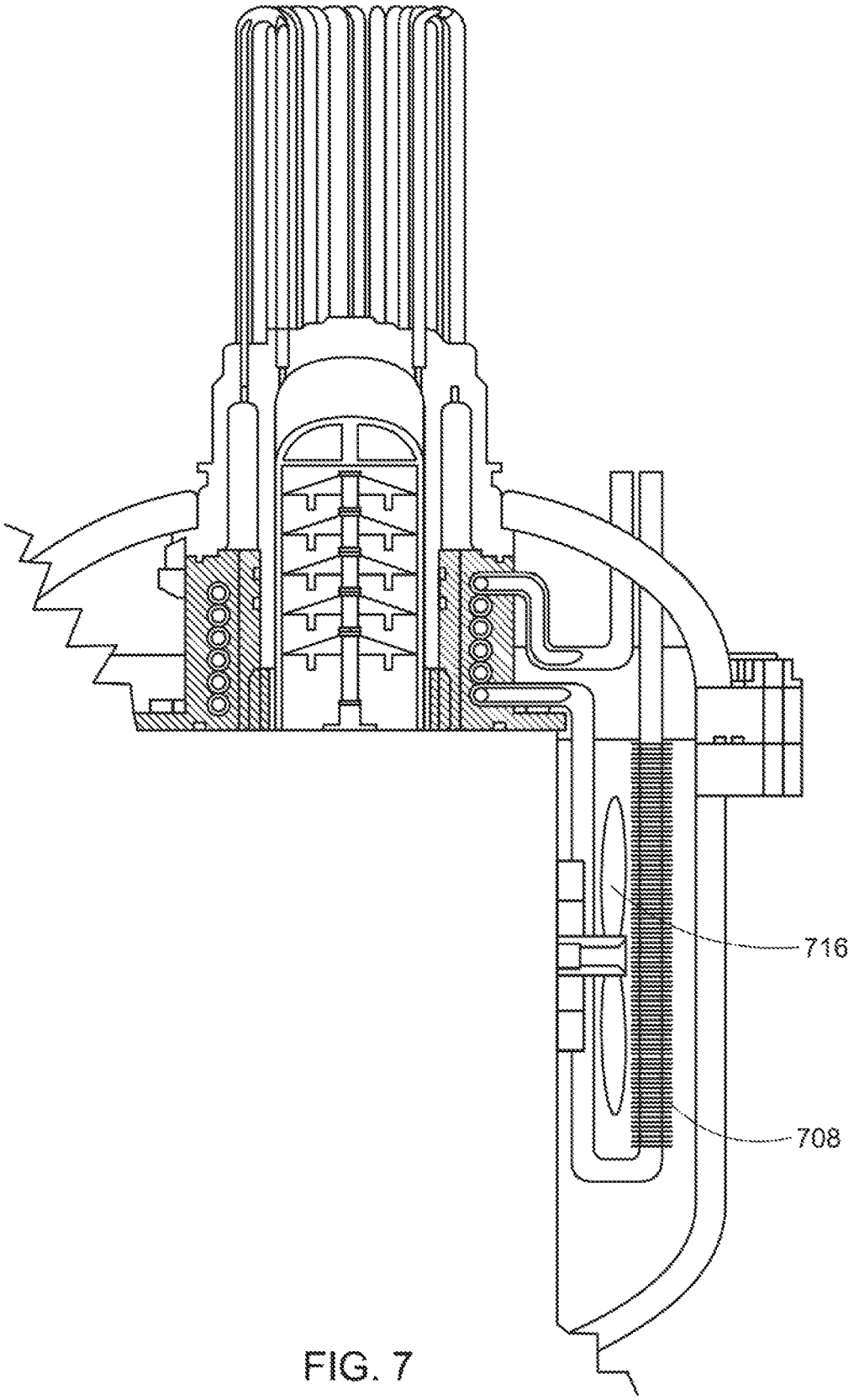
FIG. 7 shows a view of an engine in accordance with one embodiment.

The working fluid may leave the expansion engine 506 as a wet vapor, and enter the condenser 508, where it may be condensed into a liquid. The condenser 508 may be a radiator, as shown by 608 in FIG. 6, or any other condenser. The condenser 508 may be positioned within the crankcase of the expansion engine 506, as shown by numeral 708 in FIG. 7. In some embodiments, the condenser 508 may include a fan (shown as 616 in FIG. 6, and as 716 in FIG. 7), which may be driven by a crankshaft of the expansion engine 506, or by the crankshaft of the engine. The liquid working fluid leaves the condenser 508 and is recirculated into the boiler 502, where it may undergo the cycle again. The working fluid may be recirculated into the boiler 502 by a pump 510. The pump 510 may be, but is not limited to, any positive displacement pump, which may include, but is not limited to, an electric pump. In some embodiments, the pump may be mechanically driven by the expansion engine 506 (such as engine 200 in FIG. 2).

In some embodiments, to decrease the number of parts in the thermal energy recovery system and the primary engine, and increase overall efficiency, it may be desirable to have one or more shared components as possible between the thermal energy recovery system and the primary engine. In some embodiments, it may be desirable to have as many shared components as possible to increase overall efficiency.

In some embodiments, the use of a thermal energy recovery system along with a primary engine may increase the overall efficiency of the engine from 20% to 27%, resulting in an additional 7% of the chemical energy stored in the fuel being converted into electrical energy.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention.

What is claimed is:

1. A thermal energy recovery system comprising:

a reciprocating expansion engine comprising a crankcase and having a burner thermal energy output;

a generator coupled to the reciprocating expansion engine, wherein the reciprocating expansion engine converts the thermal energy output from the burner to mechanical energy output and wherein the generator converts mechanical energy output from the reciprocating expansion engine to electrical energy output and wherein the reciprocating expansion engine has vapor output;

a condenser for condensing the vapor output, the condenser positioned within the crankcase and comprising a fan;

a pump for pumping the vapor output; and a boiler in fluid communication with the pump, wherein the pump pumps the vapor output to the boiler.

2. The thermal energy recovery system of claim 1, wherein the condenser is a radiator.

3. The thermal energy recovery system of claim 1, wherein the reciprocating expansion engine is a Stirling engine.

4. The thermal energy recovery system of claim 3, wherein the Stirling engine comprises a rocking beam drive mechanism.

5. A thermal energy recovery system comprising:

a reciprocating expansion engine comprising a crankcase and having a burner thermal energy output;

a generator coupled to the reciprocating expansion engine, wherein the reciprocating expansion engine converts the thermal energy output from the burner to mechanical energy output and wherein the generator converts mechanical energy output from the reciprocating expansion engine to electrical energy output and wherein the reciprocating expansion engine has vapor output;

a condenser for condensing the vapor output, the condenser positioned within the crankcase and comprising a fan;

a boiler for receiving the vapor output; and a superheater for superheating the vapor output exiting the boiler, wherein residual heat in the superheater is transferred to the boiler.

6. The thermal energy recovery system of claim 5, wherein the reciprocating expansion engine is a Stirling engine.

7. The thermal energy recovery system of claim 5, further comprising a pump for pumping the vapor output.

8. The thermal energy recovery system of claim 7, wherein the boiler is in fluid communication with the pump, wherein the pump pumps the vapor output to the boiler.

9. A method for thermal energy recovery comprising:

capturing thermal energy output from a burner in a reciprocating expansion engine;

converting the thermal energy output to mechanical energy using the reciprocating expansion engine, the reciprocating expansion engine comprising a crankcase, the reciprocating expansion engine producing a vapor output;

converting the mechanical energy output to electrical energy output using a generator coupled to the reciprocating expansion engine;

condensing the vapor output from the reciprocating expansion engine using a condenser, the condenser positioned within the crankcase and comprising a fan; and pumping vapor output to a boiler.

10. The method for thermal energy recovery of claim 9, further comprising superheating the vapor output exiting the boiler.

11. The method for thermal energy recovery of claim 9, further comprising a superheater for superheating the vapor output exiting the boiler.

12. The method for thermal energy recovery of claim 11, wherein residual heat in the superheater is transferred to the boiler.

* * * * *